US006119835A

United States Patent [19]

Lin

[11] Patent Number: 6,119,835

[45] Date of Patent: Sep. 19, 2000

[54] LUGGAGE FRAME OF A WHEELED SUITCASE

[75] Inventor: Jer-Hong Lin, Taipei Hsien, Taiwan

[73] Assignee: Chaw Kong Co., LTD, Taipei County, Taiwan

[21] Appl. No.: 09/039,084

[22] Filed: Jan. 30, 1998

[51] Int. Cl.[7] ..... A45C 5/14; A45C 13/04; A45C 13/26; A45C 13/36

[52] U.S. Cl. ..... 190/127; 190/18 A; 190/115; 190/122

[58] Field of Search ..... 190/18 A, 115, 190/122, 127

[56] References Cited

U.S. PATENT DOCUMENTS

| | | | |
|---|---|---|---|
| 4,762,211 | 8/1988 | Krenzel | 190/122 |
| 5,115,895 | 5/1992 | Myers | 190/18 A |
| 5,167,306 | 12/1992 | Carrigan, Jr. | 190/18 A |
| 5,181,590 | 1/1993 | Carpenter et al. | 190/18 A |
| 5,295,565 | 3/1994 | Latshaw | 190/18 A |
| 5,431,428 | 7/1995 | Marchwiak et al. | 190/18 A X |
| 5,474,162 | 12/1995 | Shyr et al. | 190/18 A |
| 5,482,147 | 1/1996 | Wang | 190/18 A X |
| 5,529,156 | 6/1996 | Yang | 190/18 A X |
| 5,560,459 | 10/1996 | Lin | 190/18 A X |
| 5,588,512 | 12/1996 | Lin | 190/18 A |
| 5,653,319 | 8/1997 | Wang | 190/18 A X |
| 5,685,402 | 11/1997 | Lin | 190/115 |

*Primary Examiner*—Sue A. Weaver
*Attorney, Agent, or Firm*—Winston Hsu

[57] ABSTRACT

A luggage frame for supporting a substantially rectangular wheeled suitcase is disclosed. The luggage frame comprises a rectangular board, a U-shaped frame mounted above the board, a lower U-shaped panel attached under the board and an upper U-shaped panel attached above the U-shaped frame, an L-shaped brace mounted to the rear end of the board, the rear panel comprising a tube receiving means, an L-shaped head piece mounted to the upper end of the U-shaped frame, two elongated tubes vertically mounted between the L-shaped head piece and L-shaped brace, two wheel assemblies mounted under the rear end of the board, and a flat panel being mounted to the upper panels of the two wheel assemblies. Except for the L-shaped head piece, L-shaped brace and the two wheel assemblies which require hard tooling, all the other components can be made by using generic tools when required.

5 Claims, 6 Drawing Sheets

LUGGAGE FRAME OF A WHEELED SUITCASE

BACKGROUND OF THE INVENTION

1. Field of the Invention

This invention relates to a wheeled suitcase, and more particularly, to a modular luggage frame of a wheeled suitcase.

2. Description of the Prior Art

Wheeled suitcases have been quite popular in the market for a while. Hot competition in providing variety of new style suitcases with the same or more functionalities and also better prices has been the key concern for suitcase manufacturers. Easy to manufacture, less hard tooling change, and easy to provide suitcases of various sizes are always the design focus when designing luggage frames for various suitcases.

Please refer to FIG. 1 which discloses a luggage frame 10 of a prior art design. The luggage frame comprises a base 12, a U-shaped frame 14, an L-shaped head set 16 mounted under the top end of the U-shaped frame 14, two sockets 18 mounted on the rear end of the base 12, and two supporting tubes 20 mounted between the head set 16 and the two sockets 18. The base 12 is integrally built by using a hard tooling which comprises two wheel sockets 24 with two wheels 22 built in it, a bottom panel 30, two side panels 26 and two rear panels 28. Any change over the size of the base 12 will have to change its hard tooling which is very inconvenient and will incur a lot of cost.

The head set 16 comprises an L-shaped head piece 32, two head covers 34 and a rigid board 36 which is quite complex and requires three hard tooling for the head piece 32 and the two head covers 34. It would be much better if the head set 16 can be simplified to reduce its hard tooling and also its assembly effort.

SUMMARY OF THE INVENTION

It is therefore a primary objective of the present invention to provide a luggage frame for a wheeled suitcase which can easily to change its size without changing its hard tooling.

It is a second objective of the present invention to provide a luggage frame for a wheeled suitcase which uses less hard tooling parts when compared the prior art design, and is easier to be assembled.

Briefly, in a preferred embodiment, the present invention includes a luggage frame for supporting a substantially rectangular wheeled suitcase having a lower end, an upper end, a rear end, and a flexible cover as its outer layer, the luggage frame comprising:

(1) a substantially rectangular board having a front end, a rear end, a left end, a right end, an upper surface and a lower surface;

(2) a U-shaped frame having an upper end and two lower ends, the two lower ends being vertically mounted to the left and right ends of the rectangular board;

(3) a lower U-shaped plastic panel attached to the lower surface of the rectangular board for extending the flexible cover outside the lower end of the wheeled suitcase outward;

(4) an upper U-shaped plastic panel attached to the upper end of the U-shaped frame for extending the flexible cover outside the upper end of the wheeled suitcase outward;

(5) an L-shaped brace having a lower panel and a rear panel, the lower panel being fixedly mounted to the rear end of the rectangular board, the rear panel comprising a tube receiving means;

(6) two elongated tubes each having an upper end and a lower end, the lower ends of the two tubes being vertically mounted to the tube receiving means of the L-shaped brace;

(7) an L-shaped head piece fixedly mounted outside the rear upper end of the wheeled suitcase, the head piece comprising an upper panel and a rear panel, the upper panel being fixedly mounted to the second U-shaped plastic panel, and the upper panel further comprising a tube receiving means for engaging the upper ends of the two tubes wherein the upper ends of the two tubes are engaged in the tube receiving means of the head piece;

(8) two wheel assemblies mounted outside the rear lower end of the wheel suitcase, each of the wheel assemblies comprising an L-shaped wheel socket and a wheel mounted under the wheel socket, each wheel socket comprising a rear panel and a lower panel, each lower panel of the two wheel sockets being fixedly mounted under the rear end of the rectangular board; and (9) a lower flat panel being positioned inside the flexible cover over the rear lower end of the wheeled suitcase for protecting loadings inside the wheeled suitcase, the lower flat panel being fixedly mounted to the rear panels of the two wheel sockets with the flexible cover clamped in between.

It is an advantage of the present invention that it provides a luggage frame for a wheeled suitcase which can easily to change its size without changing its hard tooling.

It is another advantage of the present invention that it provides a luggage frame for a wheeled suitcase which uses less hard tooling parts when compared the prior art design, and is easier to be assembled.

These and other objects and the advantages of the present invention will no doubt become obvious to those of ordinary skill in the art after having read the following detailed description of the preferred embodiment which is illustrated in the various figures and drawings.

DETAILED DESCRIPTION OF THE PREFERRED EMBODIMENT

Figure 2:
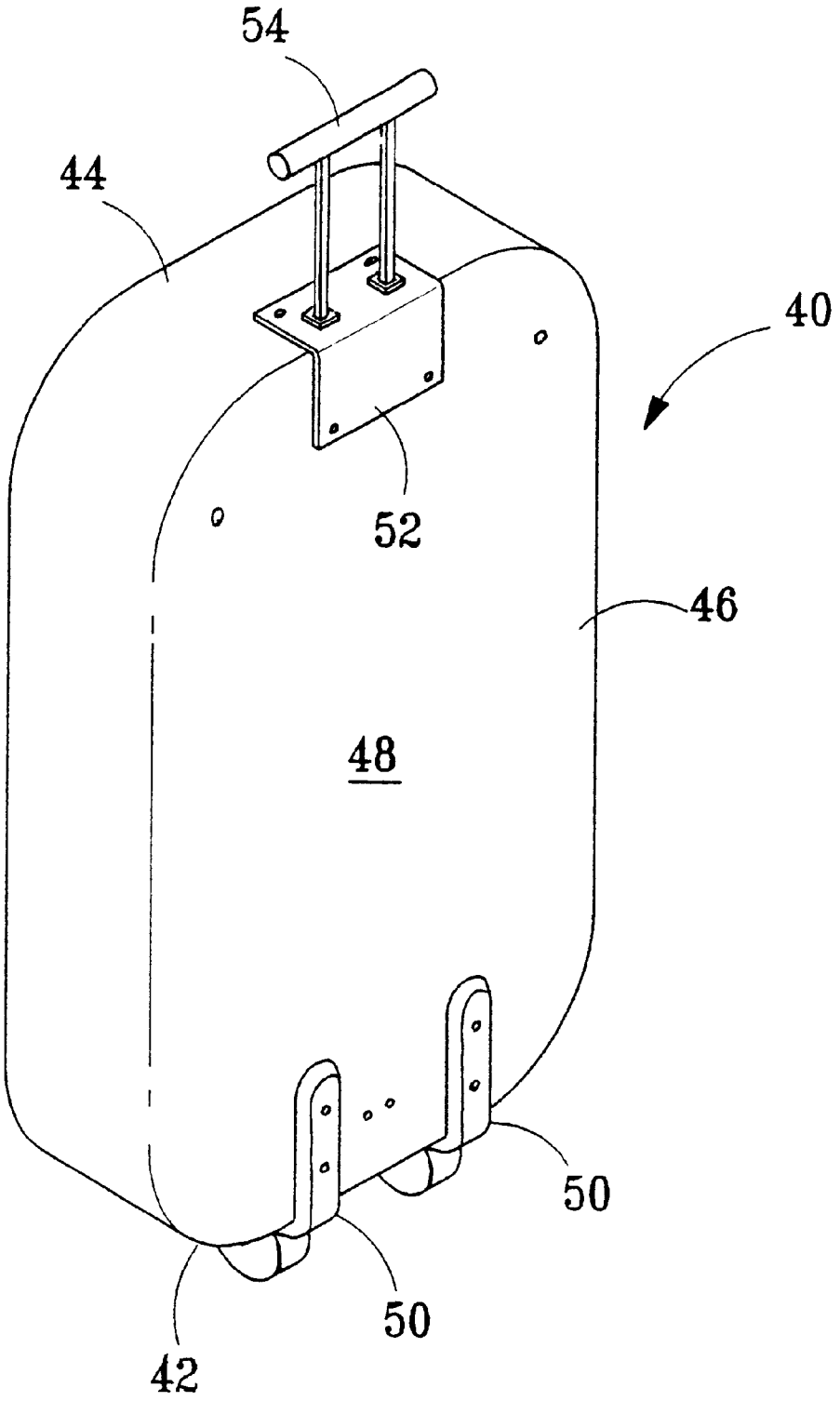
FIG. 2 is a perspective view of a wheeled suitcase according to the present invention.

Please refer to FIG. 2. FIG. 2 is a perspective view of a substantially rectangular wheeled suitcase 40 according to the present invention. The suitcase 40 has a lower end 42, an upper end 44, a rear end 46, and a flexible cover 48 as its outer layer. The suitcase 40 further comprises two wheel assemblies 50 mounted outside the rear lower end of the suitcase 40, an L-shaped head piece 52 fixedly mounted outside the rear upper end of the wheeled suitcase 40, and a U-shaped pull handle 54 telescopingly installed above the L-shaped head piece 52 for pulling or pushing the suitcase 40 when the suitcase 40 is in a tilted position.

Figure 3:
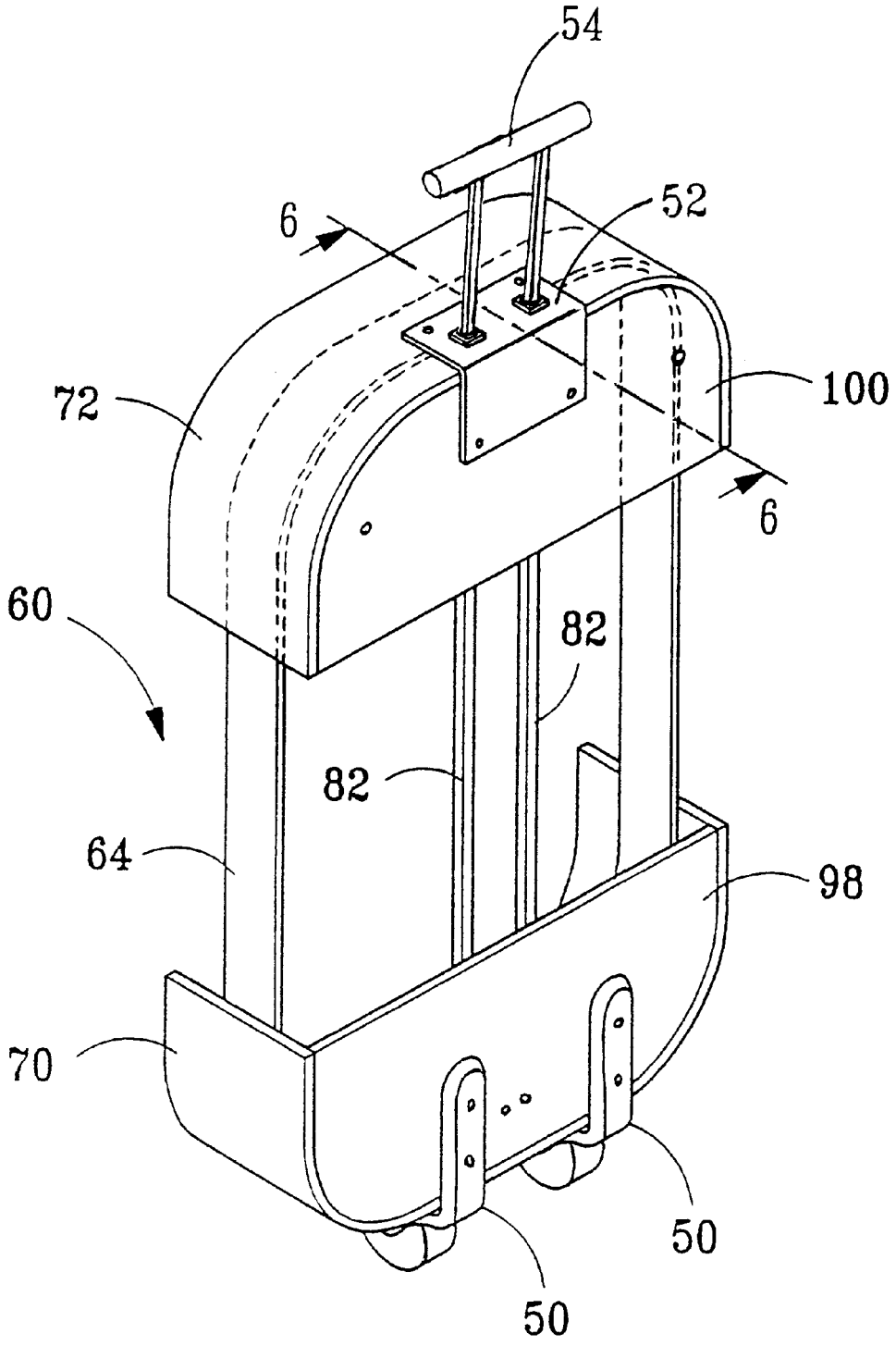
FIG. 3 is a perspective view of a luggage frame of the wheeled suitcase shown in FIG. 2.
Figure 4:
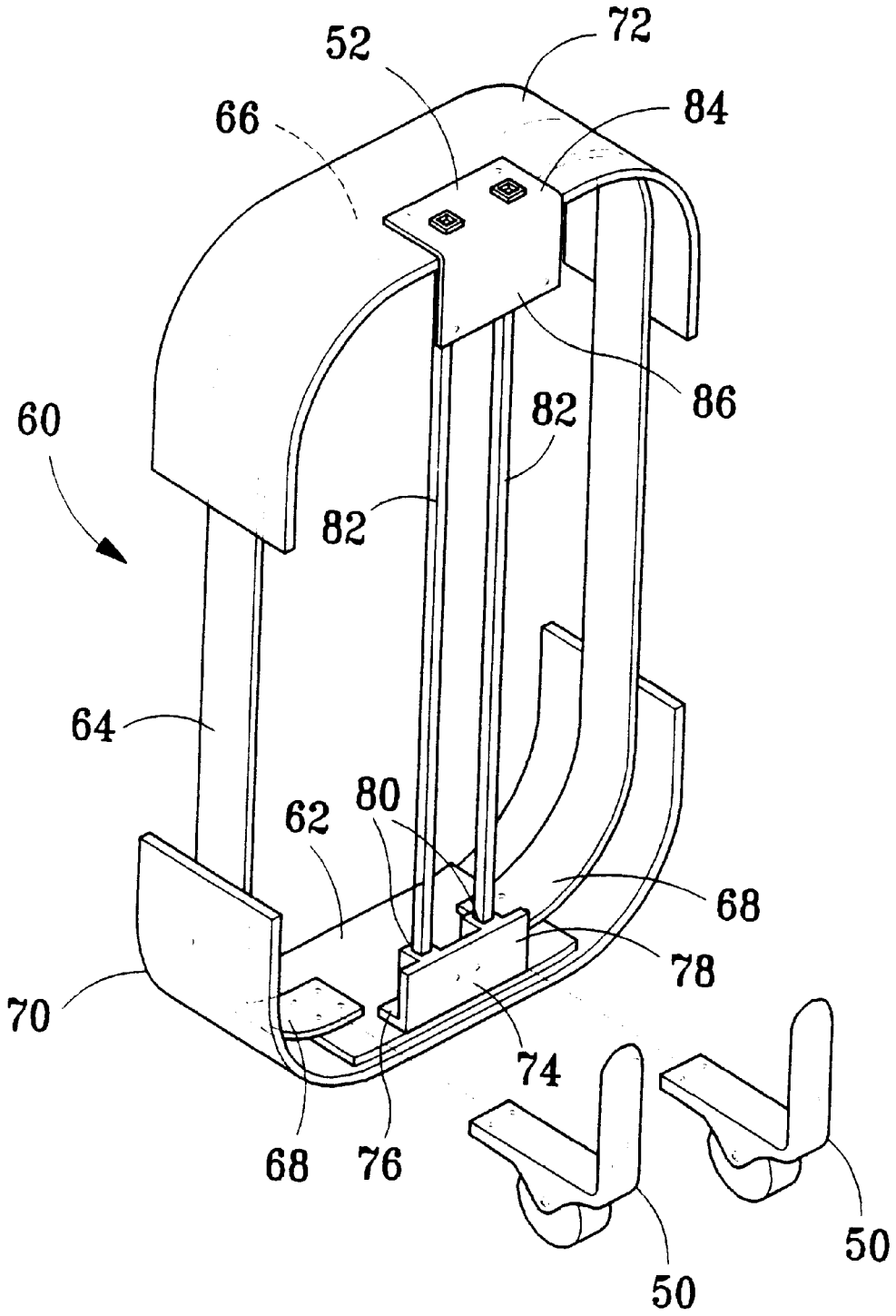
FIG. 4 is a perspective view of part of the luggage frame shown in FIG. 3.
Figure 5:
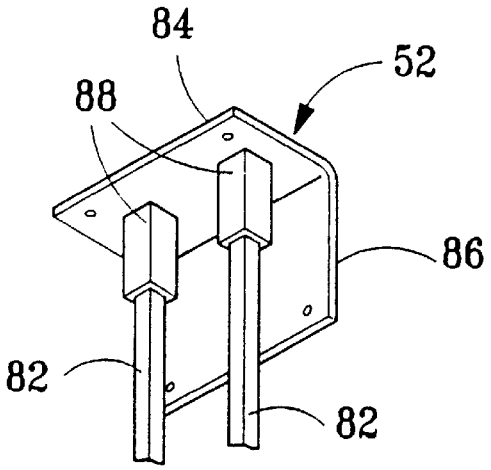
FIG. 5 shows the perspective view of the head piece connected with two supporting tubes according to the present invention.
Figure 6:
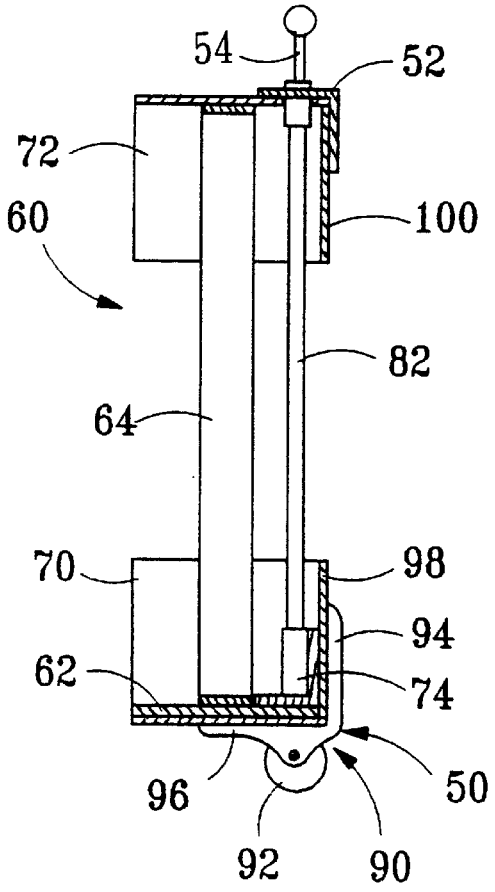
FIG. 6 is a sectional view 3—3 of the luggage frame shown in FIG. 3.
Figure 7:
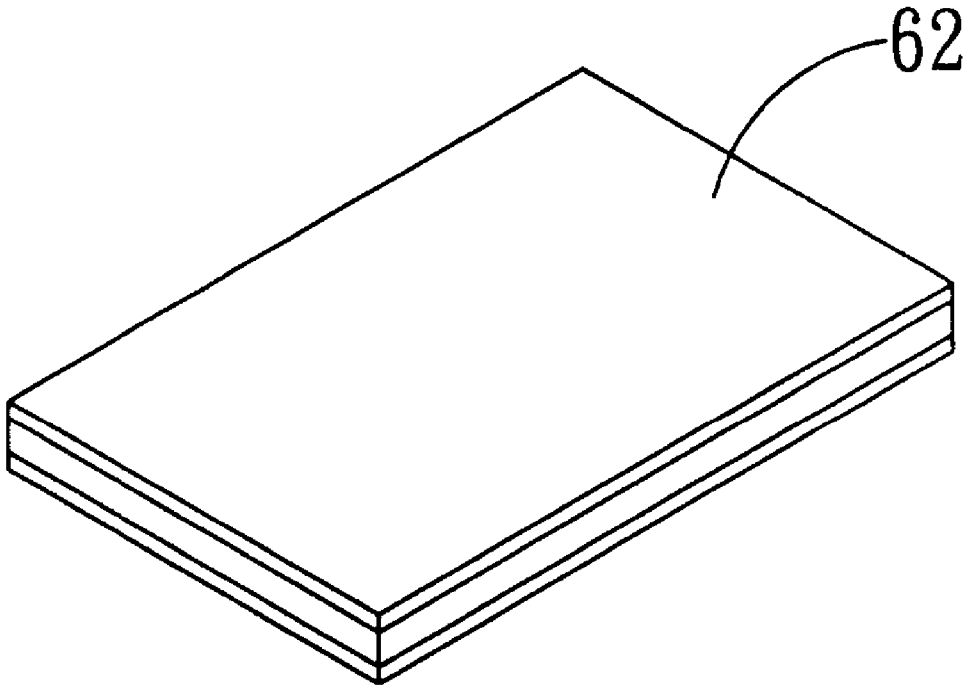
FIG. 7 is a perspective veiw of the rectangular plywood board in FIG. 4.

Please refer to FIGS. 3 to 7 which shows the construction of a luggage frame 60 for supporting the suitcase 40 shown in FIG. 2. FIG. 3 is a perspective view of the luggage frame 60. FIG. 4 is a perspective view of part of the luggage frame 60 shown in FIG. 3 with the lower and upper flat panels removed. FIG. 5 shows the perspective view of the head piece 52 connected with two supporting tubes 82. And FIG. 6 is a sectional view 3—3 of the luggage frame 60 shown in FIG. 3. FIG. 7 is a perspective veiw of the rectangular plywood board 62.

The luggage frame 60 comprises:

(1) a substantially rectangular plywood board 62 on its lower end;

(2) a U-shaped frame 64 having an upper end 66 and two lower ends 68 vertically mounted to the left and right ends of the rectangular board 62;

(3) a lower U-shaped plastic panel 70 attached to the lower surface of the rectangular board 62 for extending the flexible cover 48 outside the lower end of the suitcase 40 outward;

(4) an upper U-shaped plastic panel 72 attached to the upper end 66 of the U-shaped frame 64 for extending the flexible cover 48 outside the upper end of the suitcase 40 outward;

(5) an L-shaped brace 74 having a lower panel 76 and a rear panel 78, the lower panel 76 being fixedly mounted to the rear end of the rectangular board 62 and the rear panel 78 comprising a tube receiving means 80;

(

6) two elongated tubes 82 each having an upper end and a lower end, the lower ends of the two tubes 82 being vertically mounted to the tube receiving means 80 of the L-shaped brace 74;

(7) an L-shaped head piece 52 having an upper panel 84 and a rear panel 86, the upper panel 84 being fixedly mounted to the upper U-shaped plastic panel 72, and the upper panel 84 further comprising a tube receiving means 88 for engaging the upper ends of the two tubes 82 wherein the upper ends of the two tubes 82 are engaged in the tube receiving means 88 of the head piece 52;

(8) two wheel assemblies 50 each having an L-shaped wheel socket 90 and a wheel 92 mounted under the wheel socket 90, each wheel socket 90 comprising a rear panel 94 and a lower panel 96, each lower panel 96 of the two wheel sockets 90 being fixedly mounted under the rear end of the rectangular board 62;

(9) a lower flat plastic panel 98 being positioned inside the flexible cover 48 over the rear lower end of the wheeled suitcase 40 for protecting loadings inside the wheeled suitcase 40, the lower flat panel 98 being fixedly mounted to the rear panels 94 of the two wheel sockets 90 with the flexible cover 48 clamped in between; the lower flat panel 98 being also fixedly mounted to the rear panel 78 of the L-shaped brace 74 to strengthen the structure of the luggage frame 60;

(10) an upper flat plastic panel 100 being positioned inside the flexible cover 48 over the rear upper end of the wheeled suitcase 40 for protecting loadings inside the wheeled suitcase 40, the upper flat panel 100 being fixedly mounted to the rear panel 86 of the L-shaped head piece 52 with the flexible cover 48 clamped in between; and

(11) a U-shaped pull handle 54 telescopingly installed within the two tubes 82 through the upper panel 84 of the L-shaped head piece 52.

Some variations can be done over the luggage frame 60. For example, the two lower ends 68 of the U-shaped frame 64 can be linked together to strengthen the structure of the luggage frame 60, and the first and the second U-shaped plastic panels can also be linked together for protecting two side ends of the wheeled suitcase.

Figure 1:
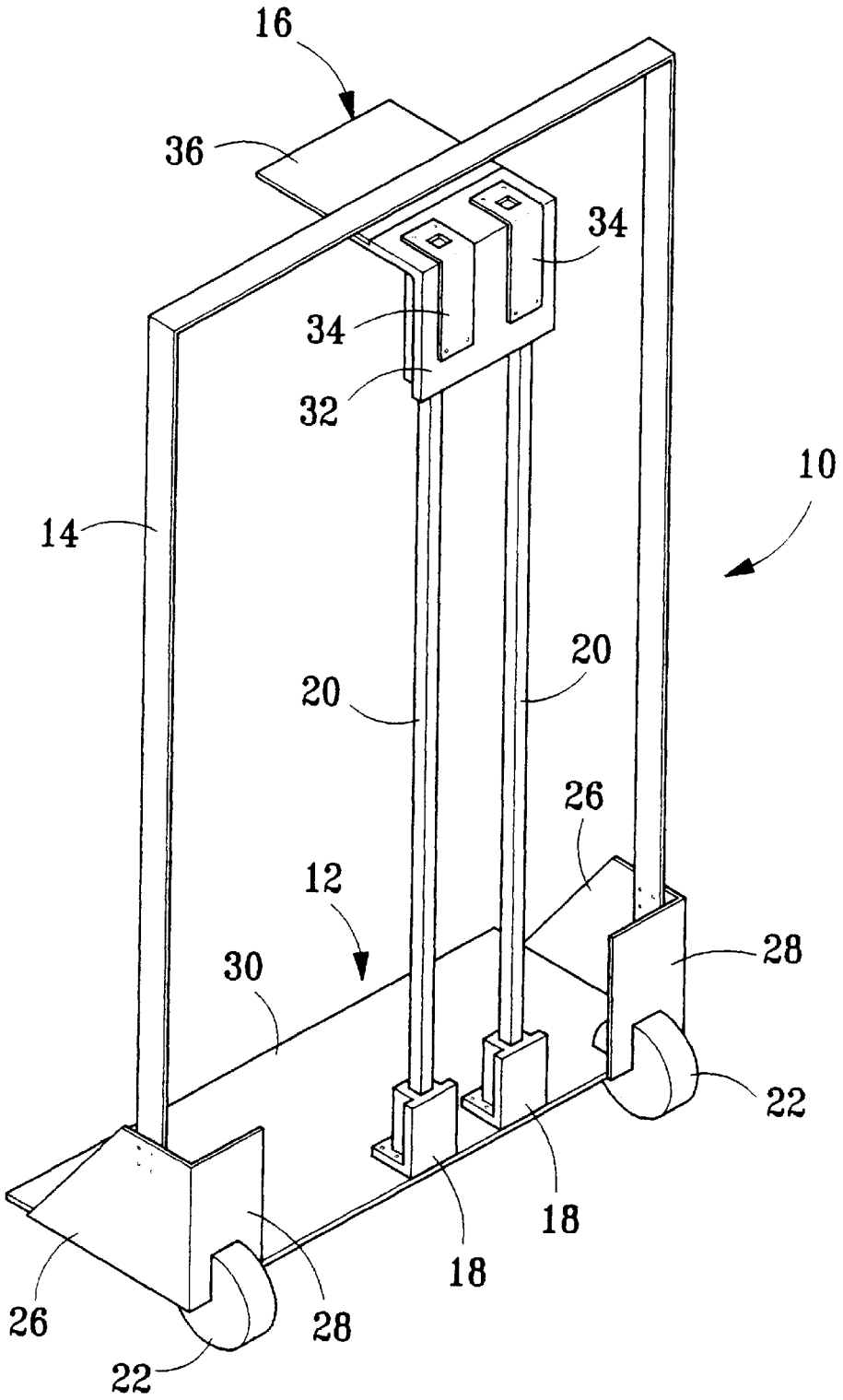
PRIOR ART FIG. 1
FIG. 1 is a perspective view of a luggage frame of a prior art design.

Compare the luggage frame 60 of the present invention with the luggage frame 10 shown in FIG.1, it can easily be seen that its head piece 52 is much simpler and is much easier to assemble than the head set 16 of the luggage frame 10. Its lower end structure formed by the rectangular board 62, the lower U-shaped plastic panel 70, the L-shaped brace 74, and the lower flat plastic panel 98, is very modular but requires only one hard tooling for the L-shaped brace 74. When the width, depth, or height of the wheeled suitcase 40 is to be changed, no hard tooling changed is required in for the parts used in the present invention, while the hard tooling of the base 12 of the prior art luggage frame 10 will have to be constantly changed if its size is to be changed.

The above disclosure is not intended as limiting. Those skilled in the art will readily observe that numerous modifications and alterations of the device may be made while retaining the teachings of the invention. Accordingly, the above disclosure should be construed as limited only by the metes and bounds of the appended claims.

What is claimed is:

1. A luggage frame for supporting a substantially rectangular wheeled suitcase having a lower end, an upper end, a rear end, and a flexible cover as its outer layer, the luggage frame comprising:

a. a substantially rectangular board having a front end, a rear end, a left end, a right end, an upper surface and a lower surface;

b. a U-shaped frame having an upper end and two lower ends, the two lower ends being vertically mounted to the left and right ends of the rectangular board;

c. a lower U-shaped panel attached to the lower surface of the rectangular board for extending the flexible cover outside the lower end of the wheeled suitcase outward;

d. an upper U-shaped panel attached to the upper end of the U-shaped frame for extending the flexible cover outside the upper end of the wheeled suitcase outward;

e. an L-shaped brace having a lower panel and a rear panel, the lower panel being fixedly mounted to the rear end of the rectangular board, the rear panel comprising a tube receiving means;

f. two elongated tubes each having an upper end and a lower end, the lower ends of the two tubes being vertically mounted to the tube receiving means of the L-shaped brace;

g. an L-shaped head piece fixedly mounted outside the rear upper end of the wheeled suitcase, the headpiece comprising an upper panel and a rear panel, the upper panel being fixedly mounted to the upper U-shaped panel, and the upper panel further comprising a tube receiving means for engaging the upper ends of the two tubes wherein the upper ends of the two tubes are engaged in the tube receiving means of the head piece;

h. a U-shaped pull handle telescopingly installed within the two tubes through the upper panel of the L-shaped head piece;

i. two wheel assemblies mounted outside the rear lower end of the wheel suitcase, each of the wheel assemblies comprising an L-shaped wheel socket and a wheel mounted under the wheel socket, each wheel socket comprising a rear panel and a lower panel, each lower panel of the two wheel sockets being fixedly mounted under the rear end of the rectangular board; and j. a lower flat panel being positioned inside the flexible cover over the rear lower end of the wheeled suitcase for protecting loadings inside the wheeled suitcase, the lower flat panel being fixedly mounted to the rear panels of the two wheel sockets with the flexible cover clamped in between, the lower flat panel being also fixedly mounted to the rear panel of the L-shaped brace for strengthening the structure of the luggage frame.

2. The luggage frame of claim 1 further comprising an upper flat panel being positioned inside the flexible cover over the rear upper end of the wheeled suitcase for protecting loadings inside the wheeled suitcase, the upper flat panel being fixedly mounted to the rear panel of the L-shaped head piece with the flexible cover clamped in between.

3. The luggage frame of claim 1 wherein the lower and the upper U-shaped panels are linked together by using the U-shaped frame for protecting two side ends of the wheeled suitcase.

4. The luggage frame of claim 1 wherein the two lower ends of the U-shaped frame are linked together by using the rectangular board for strengthening the structure of the luggage frame.

5. The luggage frame of claim 1 wherein the rectangular board is made of plywood.

* * * * *